US008741195B2

(12) United States Patent
Kurihara et al.

(10) Patent No.: US 8,741,195 B2
(45) Date of Patent: Jun. 3, 2014

(54) METHOD FOR MANUFACTURING FIBER ABSORBER

(75) Inventors: Yoshiaki Kurihara, Kawasaki (JP); Jun Hinami, Kawasaki (JP); Ryo Shimamura, Yokohama (JP); Tomohiro Takahashi, Yokohama (JP); Masashi Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 519 days.

(21) Appl. No.: 13/170,659

(22) Filed: Jun. 28, 2011

(65) Prior Publication Data

US 2012/0000376 A1 Jan. 5, 2012

(30) Foreign Application Priority Data

Jul. 2, 2010 (JP) ..... 2010-151947

(51) Int. Cl.
*B26D 7/08* (2006.01)

(52) U.S. Cl.
USPC ..... 264/154; 264/156; 264/320

(58) Field of Classification Search
USPC ..... 264/154, 156, 320
See application file for complete search history.

(56) References Cited

FOREIGN PATENT DOCUMENTS

| | | | |
|---|---|---|---|
| JP | 7-047688 | A | 2/1995 |
| JP | 7-323566 | A | 12/1995 |
| JP | 3309571 | B2 | 7/2002 |
| JP | 2004-300620 | A | 10/2004 |
| JP | 3860320 | B2 | 12/2006 |
| JP | 3142589 | U | 6/2008 |

*Primary Examiner* — James Sanders
(74) *Attorney, Agent, or Firm* — Canon USA Inc IP Division

(57) ABSTRACT

A method for manufacturing a fiber absorber includes individuating preformed fibers, compressing the preformed fibers, housing the compressed fibers in a needle-punch processing case in which needle insertion holes are formed, and performing needle punching by inserting needles through the needle insertion holes from at least three directions having perpendicular relation to one another in the needle-punch processing case.

11 Claims, 8 Drawing Sheets

METHOD FOR MANUFACTURING FIBER ABSORBER

BACKGROUND OF THE INVENTION

1. Field of the Invention

The present invention relates to a method for manufacturing an absorber using a resin fiber, and more particularly to an absorber which holds ink to supply ink to an ink jet head.

2. Description of the Related Art

Conventionally, an absorber for holding ink has been used in an ink tank which supplies ink to an ink jet head. In a state other than recording, the absorber is required to hold the ink to prevent the ink from leaking to the outside. During the recording, the absorber is required to supply the ink stably to the ink jet head. It is proposed that a foam member such as urethane foam or a fiber member such as polyolefin are used as the absorber in general, so that the ink is held by a capillary force generated therein as a negative pressure generation source.

Regarding a method for manufacturing a resin fiber absorber, the following two methods have been proposed. The first is a method for taking out a fiber material by weight equal to one absorber (hereinafter, "individuation"), and then processing the fiber material into a shape of an absorber (hereinafter, "forming").

Japanese Patent Application Laid-Open No. 7-47688 discusses a manufacturing method for forming an absorber after such individuation. While an individuation method is not described in detail, as a forming method, heating and melting of a surface of an ink absorber member configured with a resin fiber by a heater is discussed. Specifically, a fiber absorber is inserted into a mold having one surface opened, and heated by the heater in a state where constant pressure is applied from the opening to the absorber. The fiber of the absorber surface in contact with the heater is melted, and then cooled to harden. The fiber of the heated and melted place is fused. By repeating this process six times, an absorber having a hexahedral shape is acquired.

The second is a method for performing individuation after forming. Japanese Patent Application Laid-Open No. 7-323566 discusses a forming method that forms a resin fiber raw material into a thin web sheet, needle punches the sheet to mechanically entangle fibers, and then heats entire fibers to form the sheet. Then individuation into a shape of an absorber is performed by a punch die.

The ink absorber uses, as a unit for generating negative pressure to hold the ink, a capillary force generated by forming a fine void area therein. Thus, how the fine void area in the absorber can be controlled is important.

When only the absorber surface is heated and melted as discussed in Japanese Patent Application Laid-Open No. 7-47688, it may be difficult to hold the shape by suppressing a repulsive force of the absorber, which is becoming larger in recent years, for the ink tank. In other words, when the absorber is taken out of the mold for heating and melting, a shape and a size of the absorber may not be maintained due to a large fiber repulsive force. When the absorber is inserted into the ink tank, a fiber density of a portion pressed to a tank wall increases, and hence an initially designed capillary force may not be acquired.

To suppress such a fiber repulsive force, a configuration can be employed in which processing is performed not only for the absorber surface but also into the absorber. To suppress the repulsive force, as discussed in Japanese Patent Application Laid-Open No. 7-323566, setting a thermal curing step to harden the entire fiber absorber after needle-punching generally used in the textile industry is effective. However, individuation into the shape of the absorber by the punch die after the forming step, as discussed in Japanese Patent Application Laid-Open NO. 7-323566, leads to generation of waste materials depending on the size of the absorber, causing a difficulty of increasing use efficiency of raw materials.

SUMMARY OF THE INVENTION

The present invention is directed to a method for manufacturing a fiber absorber, which can simultaneously achieve more effective suppression of a repulsive force and improvement of use efficiency of raw materials.

According to the present invention, since a repulsive force can be suppressed even within a fiber absorber, a shape of the fiber absorber can be effectively maintained. According to the present invention, use efficiency of materials can be increased even when absorbers of various sizes are produced.

According to an aspect of the present invention, a method for manufacturing a fiber absorber includes:

(1) individuating opening performed fibers;

(2) compressing the opening performed fibers;

(3) housing the compressed fibers in a needle-punch processing case in which needle insertion holes are formed; and (4) performing needle punching by inserting needles through the needle insertion holes from at least three directions having vertical relation to one another in the needle-punch processing case.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5A an appearance perspective view illustrating a case for needle-punch processing; FIG. 5B a sectional view taken on a line A-A illustrated in FIG. 5A illustrating a state before needle insertion; and FIG. 5C a sectional view illustrating a state during the needle insertion.

FIG. 7A an appearance perspective view illustrating a case for needle-punch processing; FIG. 7B a schematic diagram illustrating an insertion step of an ink absorber member; FIG. 7C an appearance perspective view illustrating the ink jet cartridge; and FIG. 7D a sectional schematic diagram taken on a line B-B illustrated in FIG. 7C.

FIG. 8A an appearance perspective view illustrating a case for needle-punch processing; FIG. 8B a sectional schematic diagram taken on a line C-C illustrated in FIG. 8A illustrating a state before needle insertion; FIG. 8C a sectional schematic diagram illustrating an inserted state of a needle; and FIG. 8D a sectional schematic diagram illustrating a state after needle pulling-out.

DESCRIPTION OF THE EMBODIMENTS

Various exemplary embodiments, features, and aspects of the invention will be described in detail below with reference to the drawings.

According to the present invention, first, opening performed fibers are individuated. Individuation means taking-out of arbitrary weight of fibers from an aggregate of opening performed fibers. The individuated opening performed fibers are compressed, and then housed in a case for needle-punch processing. The needle-punch processing case includes a hole for inserting a needle. Needle punching is performed, in the needle-punch processing case, by inserting a needle into the hole from at least three directions having vertical relation to one another.

According to the present invention, since the needle punching is performed from at least the three directions having vertical relation to one another by the needle-punch processing case, the needle punching can be effectively performed even within the fibers. Hence, a shape holding capability of the fiber absorber can be improved. By taking out the fiber amount of the fiber absorber to individuate and process it, waste materials of the fibers that are raw materials can be reduced.

As the needle-punch processing case, for example, a case can be used, in which a housing portion for housing fibers is rectangular parallelepiped or cubic, and needle insertion holes are located in at least three planes of the housing portion vertical to one another. A plurality of needle-punch insertion holes can be located in all planes of the housing portion. Using such a needle-punch processing case enables fiber needling from three directions. The needle punching can be performed by vertically inserting the needle through the needle insertion hole.

FIGS. 1A to 1D schematically illustrate a processing flow of a method for manufacturing an ink absorber according to a first exemplary embodiment of the present invention. The first exemplary embodiment is described below by taking an example. An ink absorber 10 that is a fiber absorber includes an aggregate of fibers.

A fiber material constituting the fiber absorber can be appropriately selected in view of resistance properties against ink liquid contact. Examples are polyolefin, polyester, and acrylic nitride, among which the polyolefin high in chemical stability can be used. A fiber having a double-layered structure such as a core-in-sheath structure used for a general ink absorber can be selected. Specifically, different kinds of materials can be selected, for example, polypropylene (PP) for a core, and polyethylene (PE) for a sheath. A fiber material can be single. In the present exemplary embodiment, fibers of the double-layered structure (PP-PE) is adopted.

Figure 4:
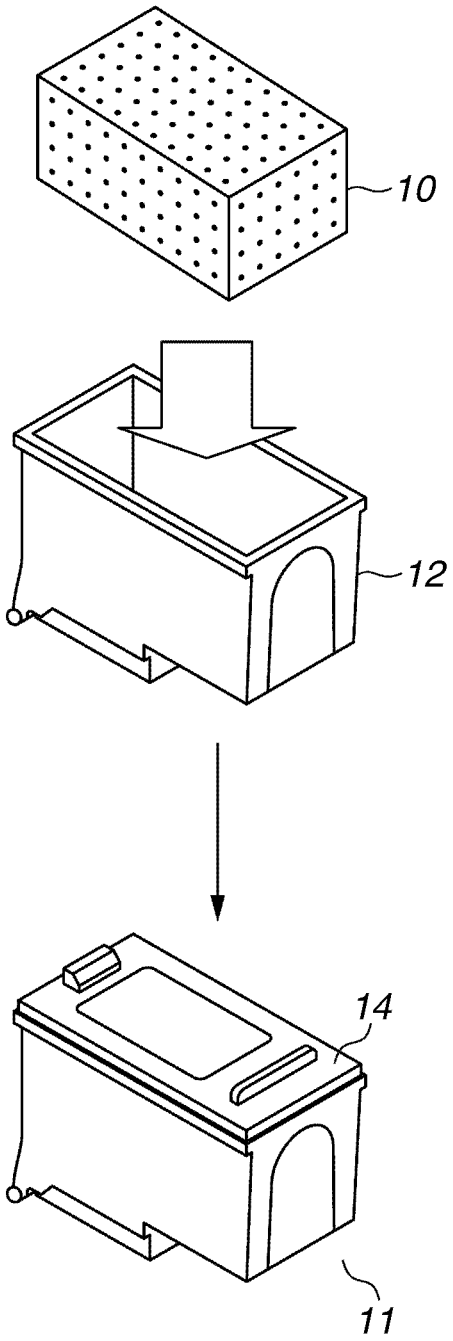
FIG. 4 is a schematic diagram illustrating a manufacturing process of an inkjet cartridge according to the first exemplary embodiment.

In addition, negative pressure, which is suitable for an ink jet cartridge, is required to be set as a function of the ink absorber 10. The negative pressure is determined mainly based on a size of a void present within the ink absorber 10. In other words, average negative pressure is determined based on a ratio (hereinafter, fiber density) of a fiber volume present in an ink housing portion to an ink housing portion volume formed in a tank case 12 (refer to FIG. 4), and a fiber diameter. A fiber density can be selected arbitrarily based on negative pressure required by each ink jet cartridge. An average fiber density in the present exemplary embodiment was set to 12%. A fiber diameter can also be selected arbitrarily as long as negative pressure characteristics are satisfied. In the present exemplary embodiment, a fiber diameter was selected to be 6.7 decitexes. A fiber length, which is not a factor to affect negative pressure characteristics, can appropriately be selected based on manufacturing needs. The fiber length can be selected arbitrarily as long as it is equal to or longer than an entangled length of fibers by needle punching. In the present exemplary embodiment, a study found that a fiber length may be useful to be set to 6 millimeters or more to hold a shape by fiber entanglement. In the present exemplary embodiment, a fiber having a length of 50 millimeters was used in view of shape holding performance after it is formed into a shape of an ink absorber.

Generally, a fiber is processed in a relatively thin (e.g., 10 millimeters or less) state, which is referred to as a web sheet, and needle punching is performed while conveying the sheet continuously. Thus, as discussed in Japanese Patent Application Laid-Open No. 7-323566, the sheet is processed only in two directions, namely, up and down, and then cut into a desired size to acquire an absorber shape. However, when processing from the sheet shape into the absorber shape is performed by diecutting or cutting as described above, waste materials is generated inevitably. As desired absorber sizes are more various, use efficiency of raw materials is reduced more. According to the present invention, therefore, to increase use efficiency of raw materials, a desired fiber amount is first taken out, and then needle punching is performed.

Figure 1A:
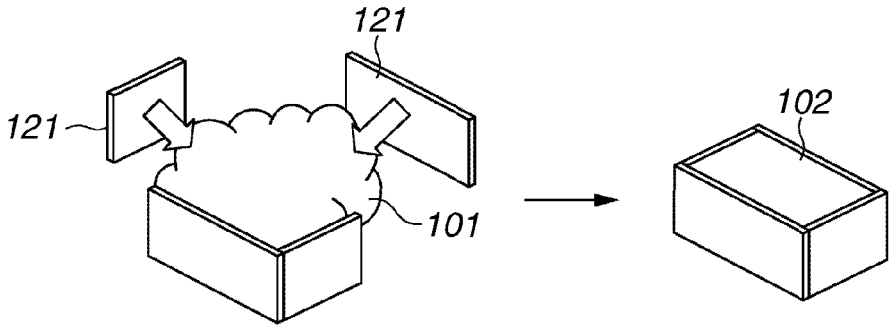
FIGS. 1A to 1D are schematic diagrams illustrating a manufacturing process of an ink absorber according to a first exemplary embodiment.

FIG. 1A illustrates a step of compressing fibers after the opening performed fibers are individuated: specifically, a step of compressing opening performed fibers into compressed fibers 102. The opening performed fibers 101 indicates fibers taken out by weight equal to one fiber absorber.

As a taking-out (individuating) method, a method generally used in the textile industry can be used. For example, a thin web sheet is manufactured by performing a fiber bundle rough opening or carding. The web sheet is processed into a sliver shape, and then cut into a predetermined size to take out fibers by weight equal to one ink absorber.

A volume of the opening performed fibers 101 can be selected arbitrarily. In other words, although the individuated sliver state can be maintained, the fibers can be set in an bulky opening state in a cotton candy shape by a compressed air force or a mechanical force as a useful example.

Then, as illustrated in FIG. 1A, the opening performed fibers 101 are compressed to acquire compressed fibers 102. To acquire the compressed fibers 102, a method for fitting the fibers in a mold prepared to achieve an absorber size or a method for sequentially compressing the fibers from respective directions to finally acquire a desired size can be used. In the present exemplary embodiment, the latter method is employed: specifically, the opening performed fibers 101 are compressed to a desired size by compression plates 121. In FIG. 1A, a compression plate 121 in a height direction is not illustrated.

Figure 1B:
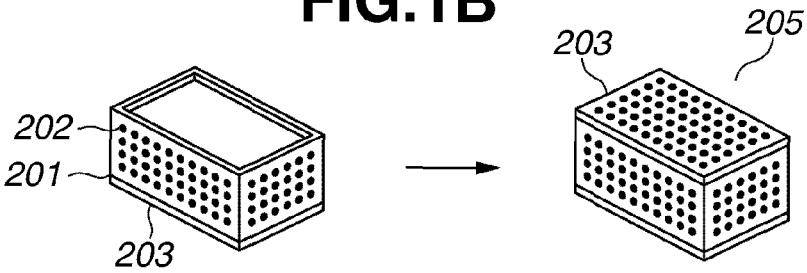

Then, as illustrated in FIG. 1B, the compressed fibers 102 are housed in a needle-punch processing case 205.

FIG. 1B illustrates a step of housing the compressed fibers 102 in the needle-punch processing case 205. In FIG. 1B, the needle-punch processing case 205 includes a processing frame body 201 and a processing lid 203. In the present exemplary embodiment, the rectangular parallelepiped form is employed. However, other forms can be selected appropriately. For example, to adjust a capillary force of the absorber, there can be a distribution of fiber densities of the absorber. In such a case, a sectional shape of the needle-punch processing case can be, for example, trapezoidal or convex.

For the processing frame body 201, to enable insertion or removal of the compressed fibers 102, a form having one plane opened or a form having two upper and lower planes opened can appropriately be selected. In the present exemplary embodiment, the form having the two upper and lower planes opened was used, and processing lids 203 to place lids up and down were prepared in addition to the processing frame body 201. The compressed fibers 102 were inserted into the processing frame body 201, and then the processing frame body 201 was closed by the processing lids 203 to acquire a state where six surfaces were surrounded with the needle-punch processing case 205.

Each of the processing frame body 201 and the processing lid 203 includes a plurality of needle insertion holes 202 formed beforehand to enable needle insertion during needle punching. Location of the needle insertion holes 202 in each plane can appropriately be selected with respect to a repulsive force of the inserted fibers. As a pitch of the needle insertion holes 202 is larger, a force to suppress a fiber repulsive force is weaker, and hence the pitch can be set to 15 millimeters or less, more usefully 10 millimeters or less. In the present exemplary embodiment, needle insertion holes 202 were formed at pitches of 5 millimeters. In the present exemplary embodiment, the processing frame body 201 in a closed state of the processing lid 203 and the needle insertion hole 202 formed in the processing lid 203 are set in such a positional relationship that tracks of needles inserted from the needle insertion holes of the respective surfaces can be orthogonal to each other.

Figure 1C:
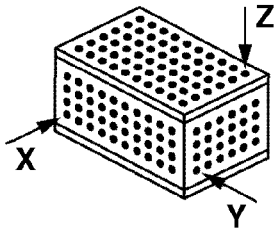

Then, as illustrated in FIG. 1C, the needles are inserted from the needle insertion holes 202, and the compressed fibers 102 are punched by the needles to be formed. FIG. 1C illustrates a step of forming in the needle-punch processing case 205: specifically, a step of inserting needle-punch needles (not illustrated, hereinafter needles) into the needle-punch processing case 205 to perform needle punching.

In the present exemplary embodiment, the hexahedral needle-punch processing case 205 illustrated in FIGS. 1A to 1D is selected, and hence as planes into which needles can be inserted, there are two planes orthogonal to each of X, Y, and Z directions. Hereinafter, the planes orthogonal to the X, Y, and Z directions are respectively abbreviated to an X plane, a Y plane, and a Z plane. There are two planes each for the X, Y, and Z plane.

For planes into which the needles are inserted, at least three planes vertical to one another are selected, and the number of planes can appropriately be selected to be three to six. The compressed fibers 102 located in the housing portion of the needle-punch processing case 205 have repulsive forces in the X, Y, and Z directions, and hence needle punching must be performed from at least three directions, namely, X, Y, and Z directions. The needle punching is advisably performed from all the six planes. When the needles can be provided corresponding to all of the plurality of needle insertion holes 202 present in one plane, the needle punching can be performed collectively in view of productivity.

Figure 1D:
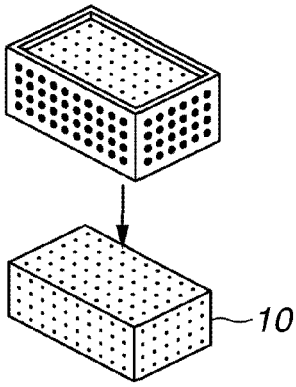

Then, as illustrated in FIG. 1D, the fibers punched by the needles and formed are taken out. FIG. 1D illustrates a step of taking out the formed fibers from the processing case: specifically, a step of removing the processing lids 203 of the up-and-down direction (Z direction) to take out the ink absorber 10.

In the present exemplary embodiment, the two surfaces of the up-and-down direction were opened to push out the ink absorber 10 from the upper direction to the lower direction, thereby acquiring the needle-punched ink absorber 10. An order of planes and the number of needle punching times can be selected arbitrarily as long as the shape of the ink absorber 10 taken out from the needle-punch processing case 205 can be held.

Figure 2A:
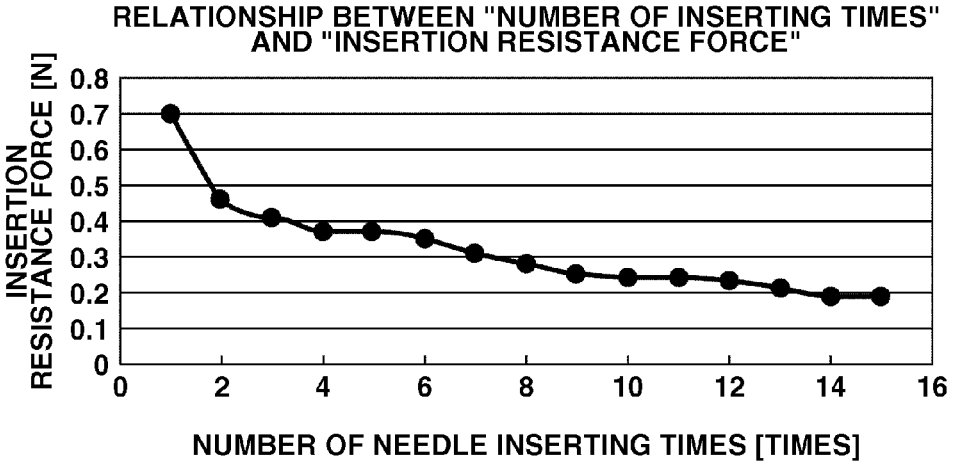
FIG. 2A illustrates a relationship between the number of needle inserting times and insertion resistance according to the first exemplary embodiment.
Figure 2B:
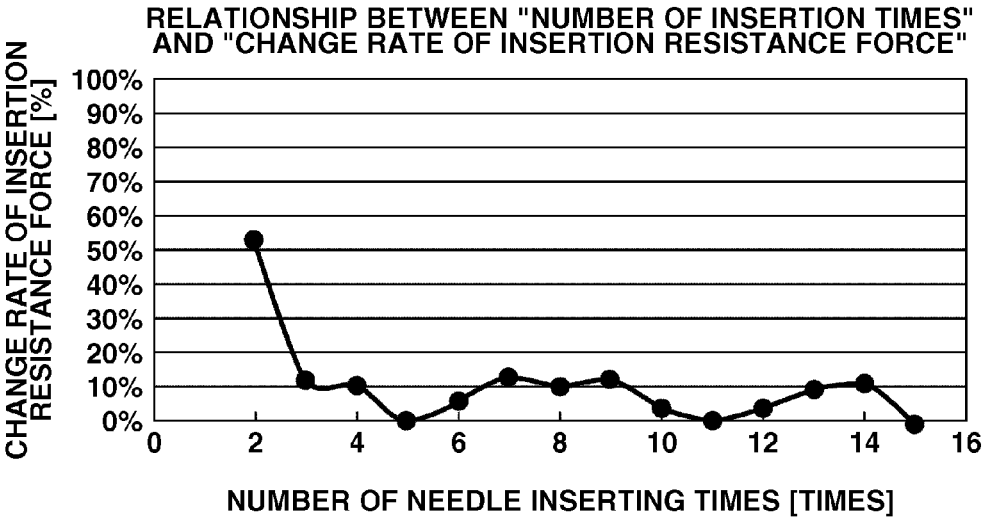
FIG. 2B illustrates a relationship between the number of needle inserting times and a change rate of insertion resistance.

In view of shape holding of the ink absorber 10, as the number of needle punching times is larger, a result may be better. However, productivity tends to decline as much. Thus, the inventors conducted a study to determine the appropriate number of needle inserting times while maintaining high productivity. The inventors measured an insertion resistive force that the needle received when one needle was inserted into the compressed fibers 102 in the needle-punch processing case 205 through the needle insertion hole 202. For numerical conversion of the insertion resistive force, Digital Force Gauge (by IMADA Co., Ltd.) was used, and the Gauge was mounted to a single-spindle robot to be moved at a constant speed. One needle was fixed to a leading edge of the Digital Force Gauge, and the insertion resistive force was measured under conditions of a needle insertion speed of 5 mm/sec., and a needle insertion amount of 20 mm/sec. FIGS. 2A and 2B illustrate measurement results.

FIG. 2A is a graph illustrating a maximum insertion resistive force that one needle receives when the needle is inserted a plurality of times into the same needle insertion hole 202. A horizontal axis indicates the number of needle inserting times, and a vertical axis indicates an insertion resistive force that the needle receives. It became clear that as the number of inserting times increases, the insertion resistive force that the needle receives decreases. As described above, in the needle punching, barbs formed in the needle catch the fibers, and the fibers are moved inside to be entangled, thereby suppressing a fiber repulsive force. Therefore, it is indicated that catching the fibers by the barbs formed in the needle becomes difficult by the fact that the insertion resistive force, which the needle receives, decreases as the number of inserting times increases. In other words, an effect of entangling the fibers in the needle punching declines from a certain number of inserting times.

In the present exemplary embodiment, a desired shape of the ink absorber 10 was successively held by inserting the needle three times or more into the needle insertion hole 202 of one place. A degree of reduction in insertion resistive force, namely, a change rate, can be represented by the following expression:

$$\text{Change rate}(\%)=\{(\text{insertion resistive force } n\text{-1st time})-(\text{insertion resistive force } n\text{-th time})\}/\text{insertion resistive force } n\text{-th time}\times 100$$

FIG. 2B illustrates a relationship between the number of inserting times and a change rate of an insertion resistive force. A horizontal axis indicates the number of needle inserting times, and a vertical axis indicates a change rate. In the abovementioned study, the desired shape of the ink absorber 10 was successfully held by inserting the needle into one hole three times or more. Therefore, needle punching may be performed by a number of times or more so that a change rate of the insertion resistive force can be 15% or less. In other words, the needle is inserted by a plurality of times until a change rate of the needle insertion resistive force becomes at least 15% or less. In the present exemplary embodiment, in view of productivity and variation in fiber repulsive forces, needle punching was performed ten times for each hole.

Figure 3:
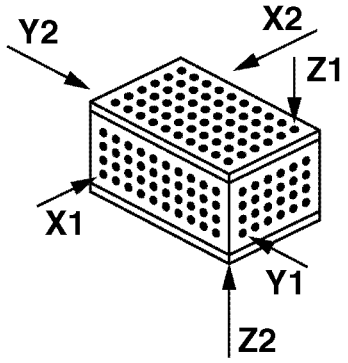
FIG. 3 illustrates a name of an each plane of a case for needle-punch.

An order of needle punching is described. FIG. 3 is an appearance perspective view illustrating the needle-punch processing case 205, in which there are names which denote needle inserting directions X1, X2, Y1, Y2, Z1, and Z2 corresponding to respective planes. There are no restrictions on an order of needle punching. For example, when needle punching is performed in all the six planes a needle can be first inserted once into each plane, totaling six planes and then the processing can be repeated until the inserting number of times n. Specifically, the needles can be inserted in an order of (Z1→Z2→X1→Y1→X2→Y2)→ (Z1→Z2→X1→Y1→X2→Y2)→. To increase productivity more, an order of Z1×n times→Z2×n times→X1×n times→Y1×n times→X2×n times→Y2×n times can be used. It is because manufacturing tact can be shortened by minimizing the number of times of positioning the needle insertion hole 202 and the needle. In the present exemplary embodiment, the latter order was selected.

The acquired ink absorber 10 was inserted into the tank case 12. Ink was injected into the ink absorber 10, and then a lid 14 was bonded to acquire an ink jet cartridge 11 (refer to FIG. 4).

The ink jet cartridge manufactured in the present exemplary embodiment is in a state where an ink discharge device (not illustrated) is mounted. Needless to say, however, the present exemplary embodiment is applied to the ink jet cartridge in which the ink discharge device is separated.

In the ink absorber 10 of the present exemplary embodiment, the fibers were put through into the absorber by the needle punching from the three directions, and hence the repulsive force of the compressed fibers was successfully suppressed, and negative pressure in the absorber was controlled as designed. As a result, evaluation of ink use-up characteristics in the acquired inkjet cartridge showed a good result. The fiber waste materials that are raw materials can be reduced by taking up a fiber amount necessary for the ink absorber 10 to individuate and then processing the fibers.

A second exemplary embodiment of the present invention is directed to a manufacturing method that simultaneously perform needle-punch from opposing planes during needle-punch processing. Differences from the first exemplary embodiment are mainly described below.

Figure 5A:
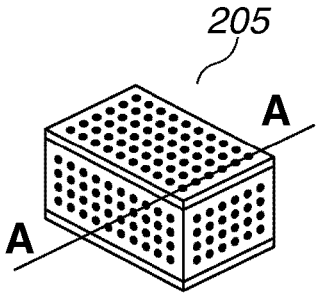
FIGS. 5A to 5C are schematic diagrams illustrating a manufacturing method according to a second exemplary embodiment.
Figure 5B:
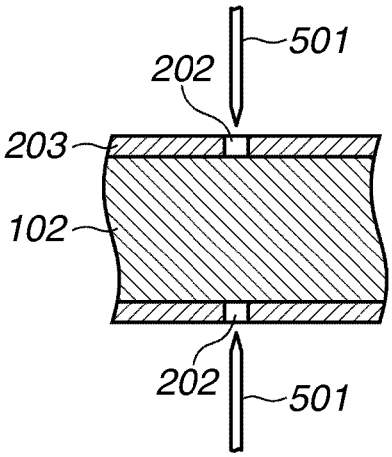
Figure 5C:
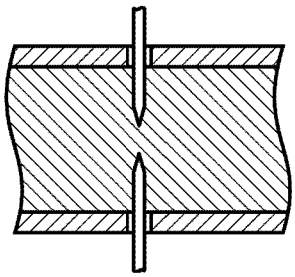

A case of inserting needles almost simultaneously from Z1 and Z2 directions of a needle-punch processing case 205 illustrated in FIGS. 5A to 5C is described. FIG. 5A is a perspective view illustrating the needle-punch processing case 205. FIGS. 5B and 5C are schematic sectional views taken on a line A-A illustrated in FIG. 5A. FIG. 5B illustrates a state where needles 501 are positioned with respect to needle-punch insertion holes 202 formed in a Z1 plane and a Z2 plane.

FIG. 5C illustrates a state where the needles 501 have been inserted into the needle-punch processing case 205 almost simultaneously from the Z1 plane and the Z2 plane. In this case, as illustrated in FIG. 5C, inside compressed fibers 102, there is an area through which no needle is put between leading edges of the upper and lower needles 501. No fiber is entangled by needle punching between the leading edge of the upper and lower needles. However, in an entire ink absorber 10, which is acquired by the process, the area where no fiber is entangled by needle punching is small, and hence a repulsive force of the fibers become smaller than that when no needle punching is performed. Thus, as long as a shape of the ink absorber 10 can be held after the needle punching, an area range where no fiber is entangled can be appropriately selected. In the present exemplary embodiment, the needles are inserted from the Z1 plane and the Z2 plane. Needless to say, however, needles can similarly be inserted from an X1 plane and an X2 plane and from a Y1 plane and a Y2 plane. In addition, needles can be inserted from all the X, Y and Z planes, or each plane can be selected as occasion demands. According to the present exemplary embodiment, since processing can be performed almost simultaneously from opposing planes, productivity can be higher than that of the first exemplary embodiment where the planes are individually punched by needles.

A third exemplary embodiment of the present invention is directed to a case where needle insertion holes 202 formed in respective planes of a needle-punch processing case are in twisted positional relationship with one another. Differences from the first exemplary embodiment are mainly described below.

Figure 6A:
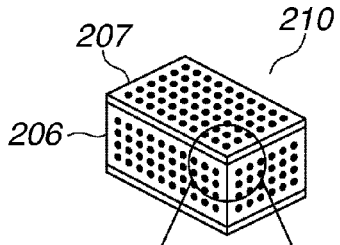
FIGS. 6A and 6B are schematic diagrams illustrating a twisted positional relationship between needle insertion holes of a needle-punch processing case according to a third exemplary embodiment.

In the present exemplary embodiment, a needle-punch processing case 210 includes, as illustrated in FIG. 6A, a processing frame body 206 and a processing lid 207. Needle insertion holes 202 formed in respective planes of the needle punch processing case 210 are in a twisted positional relationship with one another.

The twisted positional relationship means an arrangement form of needle insertion holes in which a needle inserted from one plane is not brought into contact with a needle inserted from another plane vertical to the one plane. In other words, when the needle insertion holes are arranged in a twisted positional relationship with one another, a needle inserted from a first plane of a housing portion is not brought into contact with a needle inserted from any one of planes vertical to the first plane. For example, holes can be formed in respective planes in a positional relationship where a line passing through a needle insertion hole of the first plane vertical to the plane and a line passing through a needle insertion hole of a second plane, which is vertical to the first plane, vertical to the second plane do not intersect each other. In this case, the line passing through the needle insertion hole has a diameter equal to that of the needle. Thus, since forming the needle insertion holes in a twisted positional relationship with one another prevents mechanical interferences among the needles inserted from the respective surfaces, needles can simultaneously be inserted from a plurality of not-opposing surfaces such as the X1 surface and the Y1 surface to perform needle punching. As a result, productivity can be improved more.

Figure 6B:
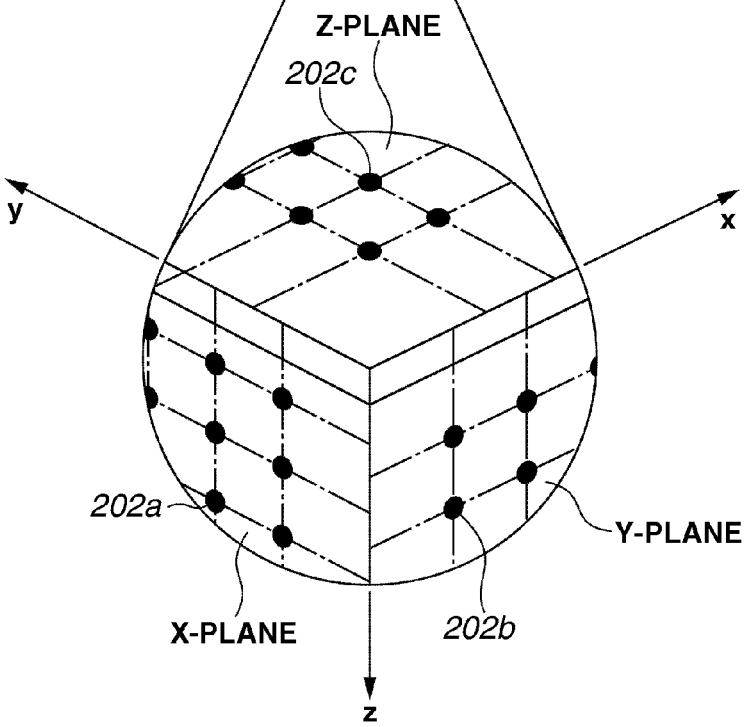

The arrangement is described more specifically referring to FIG. 6B. FIG. 6B is a partially enlarged schematic diagram of FIG. 6A. In FIG. 6B, three lines orthogonal to one another are an x direction, a y direction, and a z direction. A surface vertical to the x direction is an X-plane, a surface vertical to the y direction is a Y-plane, and a surface vertical to the z direction is a Z-plane. Needle insertion holes 202 are formed in the X-plane, the Y-plane, and the Z-plane. In FIG. 6B, the needle insertion holes are equal in diameter and pitch. A needle insertion hole 202*a* in the X-plane is shifted in the y direction with respect to a needle insertion hole 202*c* in the Z-plane. A needle insertion hole 202*a* in the X-plane is shifted in the z direction with respect to a needle insertion hole 202*b* in the Y-plane. Similarly, the needle insertion hole 202*b* in the Y-plane is shifted in the x direction with respect to the needle insertion hole 202*c* in the Z-plane. When needles are vertically inserted by the needle insertion holes in such a positional relationship to perform needle punching, needles can simultaneously be inserted from a plurality of planes.

Depending on a fiber diameter or material of compressed fibers 102, a needle diameter, a barb shape, or the number of needles, needle insertion resistance during needle punching may be considerably larger relatively than a fiber repulsive force. As a result, the fibers may be compressed and deformed in the needle-punch processing case during needle insertion. In this case, the fibers cannot be stably entangled, reducing an effect of needle punching. Thus, for example, deformation of the fibers can be prevented by inserting a needle from the Y-plane in a needle inserted state in the X-plane. In other words, by keeping a skewered state of the fibers with a needle from another plane when a needle is inserted, movement of the fibers in the needle-punch processing case 210 can be limited as much as possible. The use of such a method enables suppression of compression and deformation of the fibers during the needle punching, and hence the fibers can stably be entangled. As a result, a size of a void generated by the fibers can be stabilized.

Figure 7A:
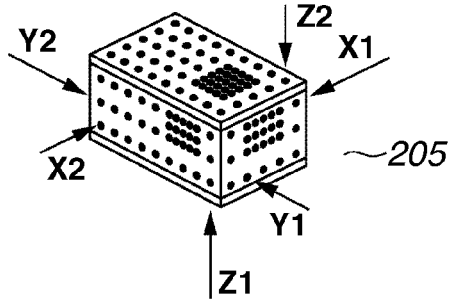
FIGS. 7A to 7D are schematic diagrams illustrating a manufacturing process of an ink jet cartridge according to a fourth exemplary embodiment.

A fourth exemplary embodiment of the present invention is directed to a method for inserting needles more densely nearer to a portion equivalent to an ink supply port 20 in an ink absorber 10. Differences from the first exemplary embodiment are mainly described below. As illustrated in FIG. 7A, in a needle-punch processing case 211 according to the present exemplary embodiment, needle insertion holes 202 are formed partially at difference pitches. In the present exemplary embodiment, when the ink absorber 10 is inserted into a tank case 12, a portion near the ink supply port 20 is densely needled. In other words, in needle insertion positions in the ink absorber, the positions are located in an area near the ink supply port relatively denser than other areas.

In FIG. 7A, when the ink absorber 10 is inserted into the tank case 12, a Z2-plane is opposed to the ink supply port 20, and a Z1-plane is opposed to an inkjet cartridge lid member 14. Similarly for an X-plane and a Y-plane, a needle insertion holes in portions near the ink supply port 20 are relatively denser than other places. Specifically, in the present exemplary embodiment, a pitch between needles in a portion near the ink supply port 20 is 3 millimeters, and pitches are 6 millimeters for other places.

Figure 7B:
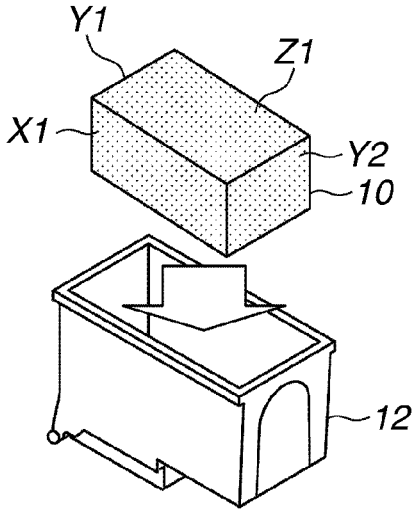
Figure 7C:
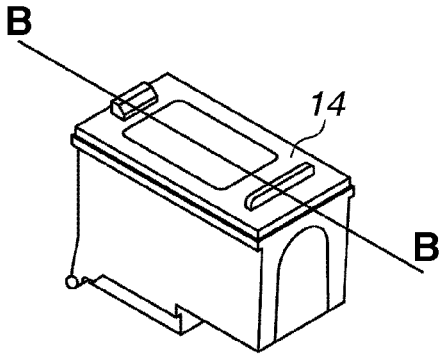
Figure 7D:
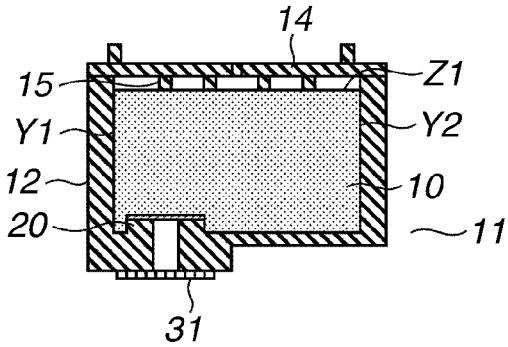

The ink absorber 10 formed as illustrated in FIG. 7A is housed in the tank case 12 as illustrated in FIG. 7B. In this case, the portion needled relatively densely as described above is housed to face the ink supply port 20. Then, as illustrated in FIG. 7C, the ink jet cartridge lid member 14 is mounted. FIG. 7D is a schematic sectional view taken on a line B-B illustrated in FIG. 7C, illustrating an arranged state of the inserted ink absorber 10. A needle insertion position of the ink absorber 10 near the ink supply port 20 for supplying ink to an ink discharge device 31 is relatively denser than other places.

As illustrated in FIG. 7D, forming lid ribs 15 in the ink jet cartridge lid member 14 enables increase of press contact between the ink absorber 10 and a filter (not illustrated) located on the ink supply port 20. By increasing a needling density of a place opposed to the ink supply port 20 as in the case of the presence exemplary embodiment, press contact is enhanced more to increase a fiber density near the ink supply port 20. As a result, a capillary force near the ink supply port 20 increases to improve ink supply characteristics.

In the present exemplary embodiment, the needles are inserted in the X, Y and Z-planes. However, for example, a portion of only the Z-plane near the ink supply port can be densely needled, and appropriately selected. In the present exemplary embodiment, the two types of needle pitches, namely, 3 millimeters and 6 millimeters, are selected. However, pitches can be changed at multiple stages.

A fifth exemplary embodiment of the present invention is directed to a method for partially heating and welding a fiber absorber by heat transmitted from needles while performing needle punching. Differences from the first exemplary embodiment are mainly described below. Depending on a fiber material or a fiber length, method for suppressing a repulsive force of fibers is required more. In the present exemplary embodiment, a needle for needle punching can be heated when inserted into a needle-punch processing case 205. For heating, a general-purpose method can be used, for example, heat transmitted from a heater.

Figure 8A:
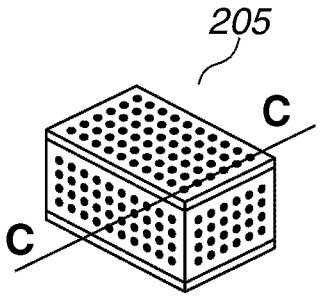
FIGS. 8A to 8D are schematic diagrams illustrating a manufacturing process according to a fifth exemplary embodiment.
Figure 8B:
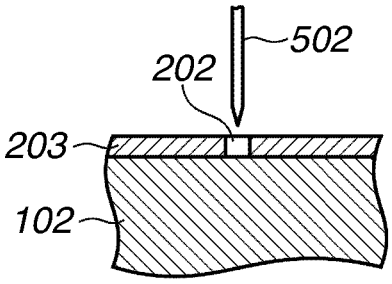
Figure 8C:
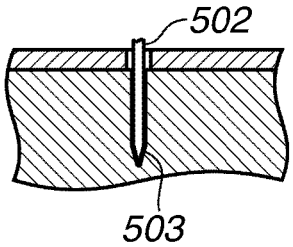
Figure 8D:
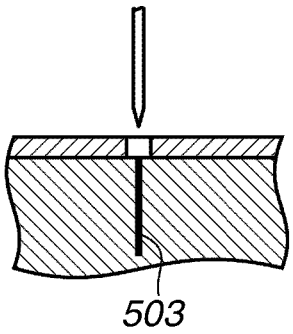

FIG. 8A is an appearance perspective view illustrating the needle-punch processing case 205 used in the present exemplary embodiment. FIGS. 8B to 8D are schematic sectional views taken on a line C-C illustrated in FIG. 8A, illustrating a processing flow. In FIG. 8B, a heatable needle 502 is positioned not to interfere with respect to a needle insertion hole 202. In this state, the needle is heated beforehand. FIG. 8C illustrates an inserted state of the needle into compressed fibers 102. The heated needle 502 catches fibers near a needle-punch lid 203 by barbs (not illustrated) formed in the needle 502 to move into the compressed fibers 102. In this case, since the needle 502 has been heated, the fibers near the needle 502 are heated to melt by transmitted heat, thereby forming a heated melted portion 503.

FIG. 8D illustrates a removed state of the needle 502 from the needle-punch processing case 205. Fibers inserted inside and surrounding fibers are heated to be bonded, and hence fibers can be efficiently bonded.

In the present exemplary embodiment, PP-PE fibers of a core-in-sheath structure are used. In the present exemplary embodiment, melting points of PP and PE are respectively 170° C. and 130° C., and a heating condition during needle punching is 160° C. For a heated melted portion 503, fibers can be completely melted to form a film. The fibers of the core-in-sheath structure can be used, and only the sheath can be melted to bond intersection points of the fibers.

Depending on a fiber material, a temperature can be increased in the needle inserted state illustrated in FIG. 8C. In this case, to prevent reduction of productivity, the fibers can be instantaneously heated and melted. For instantaneous heating, there is available a method for performing pulse-heating by a heat-generation resistor for a material of the needle 502 to weld the fibers.

Thus, according to the present exemplary embodiment, even when a fiber repulsive force is high, the fiber repulsive force can be suppressed while maintaining productivity higher than that in a method for hardening an entire absorber in a curing furnace.

Each of the exemplary embodiments is applied to the ink jet cartridge 11 detachable from a recording apparatus such as a printer. However, the present invention can be applied to a liquid absorbing member such as a subtank or waste ink absorber used in a fixed manner in the recording apparatus. The case where the number of ink absorber 10 is one has been described. However, the present invention can be applied to an ink jet cartridge 11 that includes a plurality of ink absorbers 10. Each exemplary embodiment is applied to the single-color ink jet cartridge 11. Needless to say, however, the present invention can be applied to an ink jet cartridge having a plurality of colors. According to the present invention, even when a size, a shape, and a fiber density vary from one absorber to another, waste materials of fibers that become raw materials can be reduced as much as possible. Thus, absorbers can be provided to customers more inexpensively.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-151947 filed Jul. 2, 2010, which is hereby incorporated by reference herein in its entirety.

What is claimed is:

1. A method for manufacturing a fiber absorber, comprising:

(1) individuating opening performed fibers;

(2) compressing the opening performed fibers;

(3) housing the compressed fibers in a needle-punch processing case in which needle insertion holes are formed; and (4) performing needle punching by inserting needles through the needle insertion holes from at least three directions having vertical relation to one another in the needle-punch processing case.

2. The method for manufacturing a fiber absorber according to claim 1, wherein a housing portion for housing the compressed fibers in the needle-punch processing case is rectangular parallelepiped or cubic, and the needle insertion holes are located in at least three planes of the housing portion vertical to one another.

3. The method for manufacturing a fiber absorber according to claim 2, wherein pluralities of needle insertion holes are located in all planes of the housing portion.

4. The method for manufacturing a fiber absorber according to claim 2, wherein the needles are vertically inserted.

5. The method for manufacturing a fiber absorber according to claim 4, wherein the needle insertion holes located in the planes of the housing portion are arranged in twisted positions from one another so that a needle inserted from a first plane of the housing portion is prevented from coming into contact with a needle inserted from any one of planes vertical to the first plane.

6. The method for manufacturing a fiber absorber according to claim 5, wherein in a needle inserted state from the first plane, a needle is inserted from one of the planes vertical to the first planes.

7. The method for manufacturing a fiber absorber according to claim 1, wherein the needle is inserted a plurality of times until a change rate in insertion resistive force of the needle becomes at least 15% or less.

8. The method for manufacturing a fiber absorber according to claim 1, wherein the fibers around the needle are heated to melt by heating the needle.

9. The method for manufacturing a fiber absorber according to claim 8, wherein the needle is a heat-generation resistor.

10. The method for manufacturing a fiber absorber according to claim 1, wherein the fiber absorber is an ink absorber.

11. The method for manufacturing a fiber absorber according to claim 1, wherein the fiber absorber is a waste ink absorber.

* * * * *